US010975866B2

(12) United States Patent
Sato et al.

(10) Patent No.: US 10,975,866 B2
(45) Date of Patent: Apr. 13, 2021

(54) SCROLL FLUID MACHINE AND METHOD FOR PRODUCING SAME

(71) Applicant: MITSUBISHI HEAVY INDUSTRIES THERMAL SYSTEMS, LTD., Tokyo (JP)

(72) Inventors: Hajime Sato, Tokyo (JP); Yoshiyuki Kimata, Tokyo (JP); Yohei Hotta, Tokyo (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 249 days.

(21) Appl. No.: 16/090,725

(22) PCT Filed: Aug. 14, 2017

(86) PCT No.: PCT/JP2017/029243
§ 371 (c)(1),
(2) Date: Oct. 2, 2018

(87) PCT Pub. No.: WO2018/034256
PCT Pub. Date: Feb. 22, 2018

(65) Prior Publication Data

US 2019/0120229 A1 Apr. 25, 2019

(30) Foreign Application Priority Data

Aug. 19, 2016 (JP) ..... JP2016-161210

(51) Int. Cl.
*F04C 18/02* (2006.01)
*F04C 23/00* (2006.01)
(Continued)

(52) U.S. Cl.
CPC ..... *F04C 18/0215* (2013.01); *F04C 18/0276* (2013.01); *F04C 18/0284* (2013.01);
(Continued)

(58) Field of Classification Search
CPC ..... F04C 18/0215; F04C 18/0276; F04C 18/0284; F04C 27/003; F04C 27/005; F04C 23/008; F01C 19/005
See application file for complete search history.

(56) References Cited

U.S. PATENT DOCUMENTS 4,477,238 A * 10/1984 Terauchi ..... F04C 18/0276 418/5
5,496,161 A * 3/1996 Machida ..... F04C 18/0276 418/55.2
(Continued)

FOREIGN PATENT DOCUMENTS

CN 102052302 A 5/2011
EP 2527655 A1 11/2012
(Continued)

OTHER PUBLICATIONS

English translatoin of JP 2006342776 by J Plat Pat Jun. 3, 2020.*
(Continued)

*Primary Examiner* — Deming Wan
(74) *Attorney, Agent, or Firm* — Birch, Stewart, Kolasch & Birch, LLP.

(57) ABSTRACT

Provided is a scroll fluid machine capable of effectively achieving performance of a tip seal installed in a tooth crest of a wall including an inclined portion. The inclined portion in which a distance between opposing surfaces of end plates facing each other gradually decreases from an outer peripheral side toward an inner peripheral side is provided. A tip seal (7) configured to make contact with a tooth base facing the tip seal (7) to perform sealing against fluid is provided in tip seal groove (3*d*) formed in a tooth crest of a wall (3*b*) corresponding to the inclined portion. In a stop state where a scroll (3) does not perform compression of fluid, an
(Continued)

inclination height (Ls') of the tip seal (7) is smaller than an inclination height (Ls) of the wall (3*b*).

5 Claims, 9 Drawing Sheets

(51) Int. Cl.
*F01C 19/00* (2006.01)
*F04C 27/00* (2006.01)

(52) U.S. Cl.
CPC ..... *F04C 27/00* (2013.01); *F04C 27/005* (2013.01); *F04C 2210/26* (2013.01)

(56) References Cited

U.S. PATENT DOCUMENTS

| | | | | |
|---|---|---|---|---|
| 6,050,792 | A | 4/2000 | Shaffer | |
| 6,746,224 | B2 * | 6/2004 | Itoh | F04C 18/0276 418/55.2 |
| 8,157,550 | B2 * | 4/2012 | Kudo | F01C 19/005 418/142 |
| 2002/0054821 | A1 * | 5/2002 | Takeuchi | F04C 18/0276 418/55.2 |
| 2009/0208356 | A1 | 8/2009 | Ginies et al. | |
| 2010/0092318 | A1 | 4/2010 | Sato et al. | |
| 2012/0288394 | A1 | 11/2012 | Murakami et al. | |
| 2012/0315173 | A1 | 12/2012 | Nakamura et al. | |
| 2014/0308146 | A1 | 10/2014 | Hirata et al. | |
| 2017/0370219 | A1 | 12/2017 | Takeuchi et al. | |

FOREIGN PATENT DOCUMENTS

| | | | | |
|---|---|---|---|---|
| EP | 2538083 | A1 | 12/2012 | |
| EP | 2894338 | A1 | 7/2015 | |
| JP | 7-35061 | A | 2/1995 | |
| JP | 11-190287 | A | 7/1999 | |
| JP | 2001-12365 | A | 1/2001 | |
| JP | 2002-70766 | A | 3/2002 | |
| JP | 2006342776 | A * | 12/2006 | F04C 18/088 |
| JP | 2008-133778 | A | 6/2008 | |
| JP | 2008-163895 | A | 7/2008 | |
| JP | 2009-228476 | A | 10/2009 | |
| JP | 2010-196663 | A | 9/2010 | |
| JP | 2012-36825 | A | 2/2012 | |
| JP | 2014-80940 | A | 5/2014 | |
| JP | 2015-55173 | A | 3/2015 | |
| JP | 2016-102486 | A | 6/2016 | |

OTHER PUBLICATIONS

Extended European Search Report, dated May 13, 2019, for European Application No. 17841496.7.

Extended European Search Report, dated May 31, 2019, for European Application No. 17841476.9.

Written Opinion of the International Searching Authority and International Search Report, dated Oct. 17, 2017, for International Application No. PCT/JP2017/029327, with English translations.

Written Opinion of the International Searching Authority and International Search Report, dated Oct. 24, 2017, for International Application No. PCT/JP2017/029241, with English translations.

Written Opinion of the International Searching Authority and International Search Report, dated Oct. 31, 2017, for International Application No. PCT/JP2017/029243, with English translations.

U.S. Office Action for U.S. Appl. No. 16/093,753, dated Jul. 24, 2020.

U.S. Office Action for U.S. Appl. No. 16/097,749, dated Sep. 15, 2020.

* cited by examiner

SCROLL FLUID MACHINE AND METHOD FOR PRODUCING SAME

TECHNICAL FIELD

The present invention relates to a scroll fluid machine and a method for manufacturing the same.

BACKGROUND ART

A scroll fluid machine in which a fixed scroll member including a spiral-shaped wall provided on an end plate and an orbiting scroll member including a spiral-shaped wall provided on an end plate are engaged with each other and rotated in orbital motion to compress or expand fluid is generally known.

A so-called stepped scroll compressor such as that disclosed in Patent Document 1 is known as the above-mentioned scroll fluid machine. In this stepped scroll compressor, a step is provided at a position along the spiral direction in the tooth crest surfaces and the tooth base surfaces of the spiral-shaped walls of the fixed scroll and the orbiting scroll such that the height of the wall is greater on the outer peripheral side of the step than on the inner peripheral side of the step. The stepped scroll compressor performs compression (three-dimensional compression) not only in the circumferential direction of the wall, but also in the height direction, and therefore can achieve a larger displacement and a larger compressor capacity in comparison with a common scroll compressor (two-dimensional compression) that does not include the step.

CITATION LIST

Patent Document

Patent Document 1: JP 2015-55173 A

SUMMARY OF INVENTION

Problem to be Solved by the Invention

In the stepped scroll compressor, however, fluid leakage at the step is disadvantageously large. In addition, stress is concentrated at the root portion of the step, and the strength is disadvantageously reduced.

In view of this, the inventor et al. have considered regarding a configuration provided with a continuous inclined portion in place of the step provided in the wall and the end plate. In addition, a tip seal is provided in the tooth crest of the wall for the purpose of sealing the gap between the tooth crest and the opposing tooth base.

However, since the inclined portion is formed in the wall, the way of installing the tip seal to achieve desired performance has not yet been considered.

In view of the foregoing, an object of the present invention is to provide a scroll fluid machine and a method for manufacturing the same which can achieve desired performance of a tip seal installed in a tooth crest of a wall including an inclined portion.

Solution to Problem

A scroll compressor and a method for manufacturing the same according to an embodiment of the present invention employ the following means to solve the problems described above.

A scroll fluid machine according to an aspect of the present invention includes: a first scroll member including a first end plate and a first wall provided on the first end plate, the first wall having a spiral shape; and a second scroll member including a second end plate that is disposed to face the first end plate, and a second wall provided on the second end plate, the second scroll member being configured to relatively rotate in orbital motion with the second wall engaged with the first wall, the second wall having a spiral shape. An inclined portion in which a distance between opposing surfaces of the first end plate and the second end plate facing each other gradually decreases from an outer peripheral side toward an inner peripheral side of the first wall and the second wall is provided, a tip seal is provided in groove portions formed in tooth crests of the first wall and the second wall corresponding to the inclined portion, the tip seal being configured to make contact with a tooth base facing the tip seal to perform sealing against fluid, and in a stop state where the scroll members do not perform compression of fluid, an inclination height of the tip seal is smaller than an inclination height of the wall.

Since an inclined portion in which the distance between opposing surfaces of the first end plate and the second end plate facing each other gradually decreases from the outer peripheral side toward the inner peripheral side of the wall is provided, the fluid sucked from the outer peripheral side is compressed not only by reduction of a compression chamber corresponding to the spiral shape of the wall, but also by reduction of the distance between the opposing surfaces of the end plates as the fluid moves toward the inner peripheral side.

The inclination height of the tip seal is set to a value smaller than that of the inclination height of the wall in a stop state where compression of fluid is not performed by the scroll members. With this configuration, the tip seal is installed such that, in the stop state, the tip seal protrudes from the tooth crest to the opposing tooth base side more on the inner periphery side than on the outer peripheral side. Since the tip seal protrudes from the tooth crest to the tooth base side more on the inner periphery side than on the outer peripheral side, fluid enters, more easily on the inner peripheral side than on the outer peripheral side, the groove portion in which the tip seal is inserted. When an operation is started from the stop state and the compression of the fluid is performed by the scrolls, the compressed fluid enters the groove portion of the inner periphery side of the tip seal, and biases the tip seal toward the tooth base from the back surface of the tip seal. Accordingly, the pressing forth of the tip seal against the tooth base is larger on the inner periphery side where the fluid pressure is high during operation, and thus a high sealing performance can be achieved, improving the performance of the scroll fluid machine.

It is to be noted that the "inclination height" means the difference between the height of the outermost peripheral end and the height of the innermost peripheral end of the inclined portion.

Further, in the scroll fluid machine according to an aspect of the present invention, the height of the tip seal in the height direction of the wall is greater than the difference between the inclination height of the wall and the inclination height of the tip seal.

Since the height of the tip seal in the height direction of the wall is greater than the difference between the inclination height of the wall and the inclination height of the tip seal, the tip seal is prevented from dropping off from the groove portion.

Further, in the scroll fluid machine according to an aspect of the present invention, the tip seal is made of an elastically deformable material.

When the tip seal is made of an elastically deformable material (such as resin), the tip seal can be installed in the groove portion by utilizing elastic deformation such that the inclination height of the tip seal is smaller than the inclination height of the wall in a stop state. As a result, it is unnecessary to form the tip seal in a shape inclined in the height direction, and therefore, by manufacturing a flat tip seal that has no inclination, the ease of manufacture and inspection of the tip seal increases.

A manufacturing method according to an aspect of the present invention is a method of manufacturing a scroll fluid machine including: a first scroll member including a first end plate and a first wall provided on the first end plate, the first wall having a spiral shape; and a second scroll member including a second end plate that is disposed to face the first end plate, and a second wall provided on the second end plate, the second scroll member being configured to relatively rotate in orbital motion with the second wall engaged with the first wall, the second wall having a spiral shape, wherein an inclined portion in which a distance between opposing surfaces of the first end plate and the second end plate facing each other gradually decreases from an outer peripheral side toward an inner peripheral side of the first wall and the second wall is provided, and a tip seal is provided in groove portions formed in tooth crests of the first wall and the second wall corresponding to the inclined portion, the tip seal being configured to make contact with a tooth base facing the tip seal to perform sealing against fluid, the method including: installing the tip seal in the groove portions such that an inclination height of the tip seal is smaller than an inclination height of the wall; and installing the first scroll member and the second scroll member by engaging the first scroll member with the second scroll member after installing the tip seal.

Since the scroll members are engaged with each other and installed after the tip seal is installed such that the inclination height of the tip seal is smaller than the inclination height of the wall, it is possible to readily set the state where the tip seal protrudes to the tooth base side more on the inner periphery side than on the outer peripheral side in the stop state before the compression of the fluid is performed.

Advantageous Effect of Invention

With the configuration in which the inclination height of the tip seal is set to a value smaller than that of the inclination height of the wall in the stop state where the compression of the fluid is not performed by the scroll members, the pressing forth of the tip seal against the tooth base is high on the inner periphery side where the fluid pressure is high during operation, and thus a high sealing performance can be achieved, improving the performance of the scroll fluid machine.

BRIEF DESCRIPTION OF DRAWINGS

FIG. 1A is a longitudinal sectional view, and FIG. 1B is a plan view as viewed from the wall side of the fixed scroll.

FIG. 7A is a side view illustrating a state where the tip seal gap is relatively small, and FIG. 7B is a side view illustrating a state where the tip seal gap is relatively large.

FIG. 9A is a longitudinal sectional view illustrating a combination with a scroll provided with no step, and FIG. 9B is a longitudinal sectional view illustrating a combination with a stepped scroll.

DESCRIPTION OF EMBODIMENTS

Embodiments of the present invention will be described below with reference to the drawings.

Figure 1A:
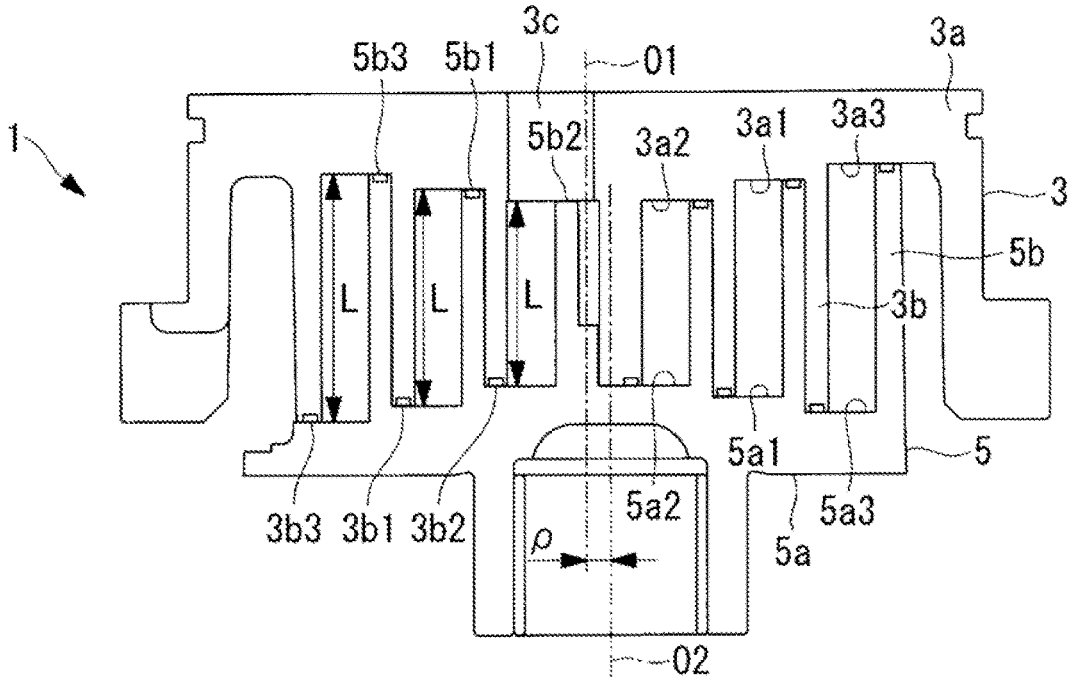
FIGS. 1A and 1B illustrate a fixed scroll and an orbiting scroll of a scroll compressor according to an embodiment of the present invention.
Figure 1B:
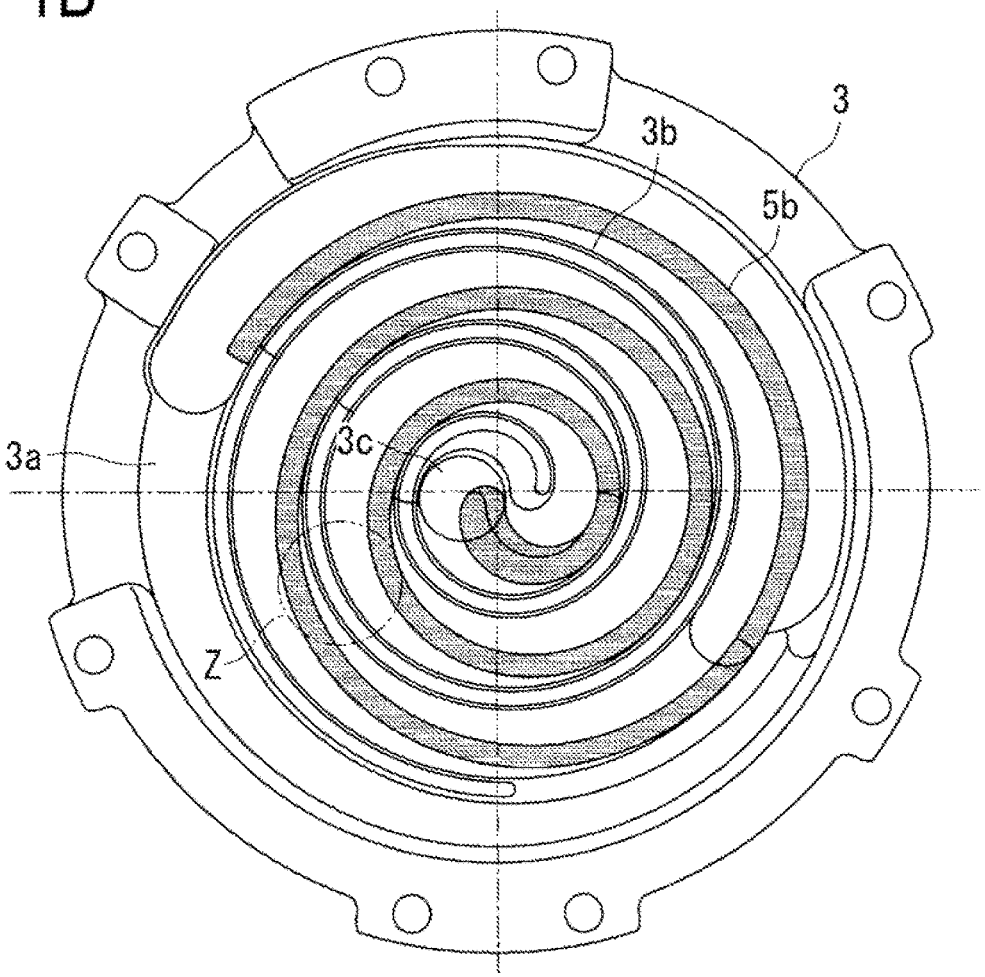

FIGS. 1A and 1B illustrates a fixed scroll (first scroll member) 3 and an orbiting scroll (second scroll member) 5 of a scroll compressor (scroll fluid machine) 1. The scroll compressor 1 is used as a compressor that compresses gas refrigerant (fluid) for performing refrigeration cycle of an air conditioner or the like, for example.

The fixed scroll 3 and the orbiting scroll 5 are compression mechanisms made of metal such as aluminum alloy and iron, and are housed in a housing not illustrated. The fixed scroll 3 and the orbiting scroll 5 suck, from the outer peripheral side, fluid guided into the housing, and discharge compressed fluid from a discharge port 3*c* located at the center of the fixed scroll 3.

The fixed scroll 3 is fixed to the housing, and includes a substantially disk-plate-shaped end plate (first end plate) 3*a*, and a spiral-shaped wall (first wall) 3*b* disposed upright on one side surface of the end plate 3*a* as illustrated in FIG. 1A. The orbiting scroll 5 includes a substantially disk-plate-shaped end plate (second end plate) 5*a*, and a spiral-shaped wall (second wall) 5*b* disposed upright on one side surface of the end plate 5*a*. The spiral shapes of the walls 3*b* and 5*b* are defined by involute, Archimedean spiral or the like, for example.

The fixed scroll 3 and the orbiting scroll 5 are engaged with each other such that the centers thereof are separated from each other by an orbit radius p and that the phases of the walls 3*b* and 5*b* are shifted by 180°, and fixed scroll 3 and the orbiting scroll 5 are mounted such that a slight clearance (tip clearance) in the height direction is provided between the tooth crest and the tooth base of the walls 3*b* and 5*b* of the scrolls at normal temperature. With this configuration, multiple pairs of compression chambers that are defined by the surrounding end plates 3*a* and 5*a* and the walls 3*b* and 5*b* and are symmetric about the scroll center are formed between the scrolls 3 and 5. With a rotation prevention mechanism such as an Oldham ring not illustrated, the orbiting scroll 5 rotates in orbital motion around the fixed scroll 3.

As illustrated in FIG. 1A, an inclined portion, in which a distance L between opposing surfaces of the end plates 3*a* and 5*a* facing each other gradually decreases from the outer peripheral side toward the inner peripheral side of the spiral-shaped walls 3*b* and 5*b*, is provided.

Figure 2:
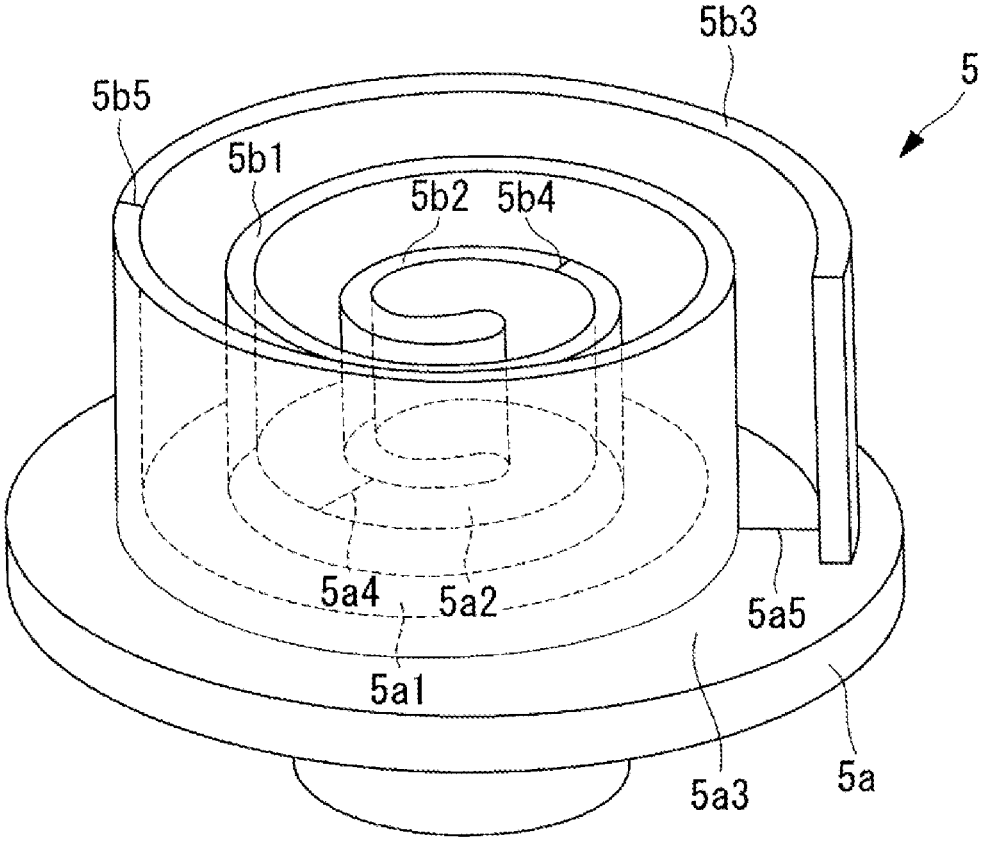
FIG. 2 is a perspective view illustrating the orbiting scroll illustrated in FIGS. 1A and 1B.

As illustrated in FIG. 2, the wall 5*b* of the orbiting scroll 5 is provided with a wall inclined portion 5*b*1 whose height gradually decreases from the outer peripheral side toward the inner peripheral side. An end plate inclined portion 3*a*1 (see FIG. 1A) that is inclined in accordance with the inclination of the wall inclined portion 5*b*1 is provided in the tooth base surface of the fixed scroll 3 that faces the tooth crest of the wall inclined portion 5*b*1. With the wall inclined portion 5*b*1 and the end plate inclined portion 3*a*1, a continuous inclined portion is defined. Likewise, the wall 3*b* of the fixed scroll 3 is provided with a wall inclined portion 3*b*1 whose height is gradually inclined from the outer peripheral side toward the inner peripheral side, and an end plate inclined portion 5*a*1 that faces the tooth crest of the wall inclined portion 3*b*1 is provided in the end plate 5*a* of the orbiting scroll 5.

It is to be noted that the term "gradually" in the inclined portion in the present embodiment is not limited to a smooth inclination, and may include a form that is visually recognized as being gradually inclined as viewed in the entire inclined portion in which small steps inevitably resulting from working processes are connected together stepwise. It should be noted that large steps such as a so-called stepped scroll is not included.

A coating is provided on the wall inclined portions 3*b*1 and 5*b*1 and/or the end plate inclined portions 3*a*1 and 5*a*1. Examples of the coating include manganese phosphate treatment, nickel phosphor plating, and the like.

As illustrated in FIG. 2, wall flat portions 5*b*2 and 5*b*3, each of which has a constant height, are provided on the innermost peripheral side and the outermost peripheral side, respectively, of the wall 5*b* of the orbiting scroll 5. The wall flat portions 5*b*2 and 5*b*3 are provided in a region of 180° around center O2 of the orbiting scroll 5 (see FIG. 1A). Wall inclined connecting portions 5*b*4 and 5*b*5, which serve as bent portions, are provided at portions connecting between the wall inclined portion 5*b*1 and the wall flat portions 5*b*2 and 5*b*3, respectively.

Likewise, the tooth base of the end plate 5*a* of the orbiting scroll 5 is provided with end plate flat portions 5*a*2 and 5*a*3, each of which has a constant height. Likewise, the end plate flat portions 5*a*2 and 5*a*3 are provided in a region of 180° around the center of the orbiting scroll 5. End plate inclined connecting portions 5*a*4 and 5*a*5, which serve as bent portions, are provided at portions connecting between the end plate inclined portion 5*a*1 and the end plate flat portions 5*a*2 and 5*a*3, respectively.

Figure 3:
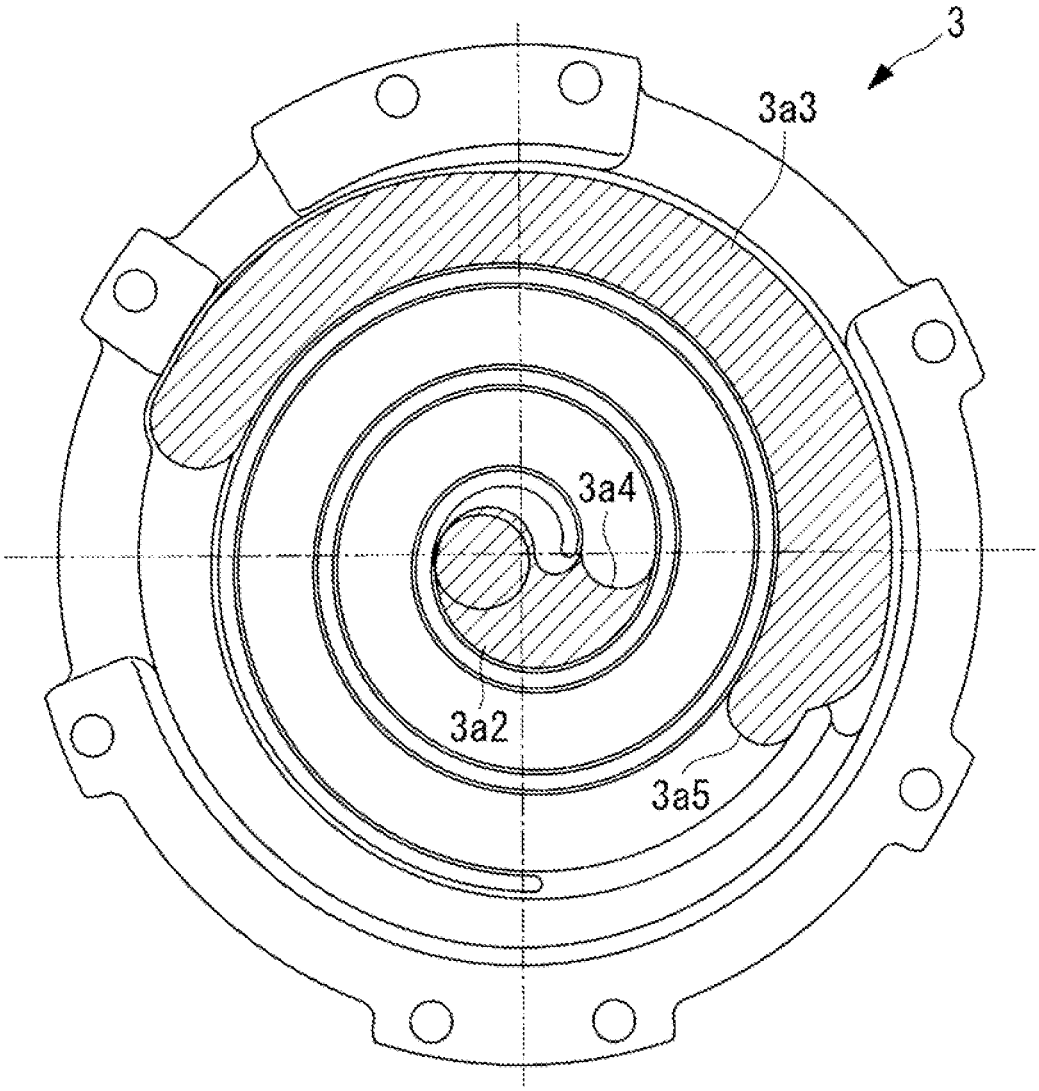
FIG. 3 is a plan view illustrating an end plate flat portion provided in the fixed scroll.
Figure 4:
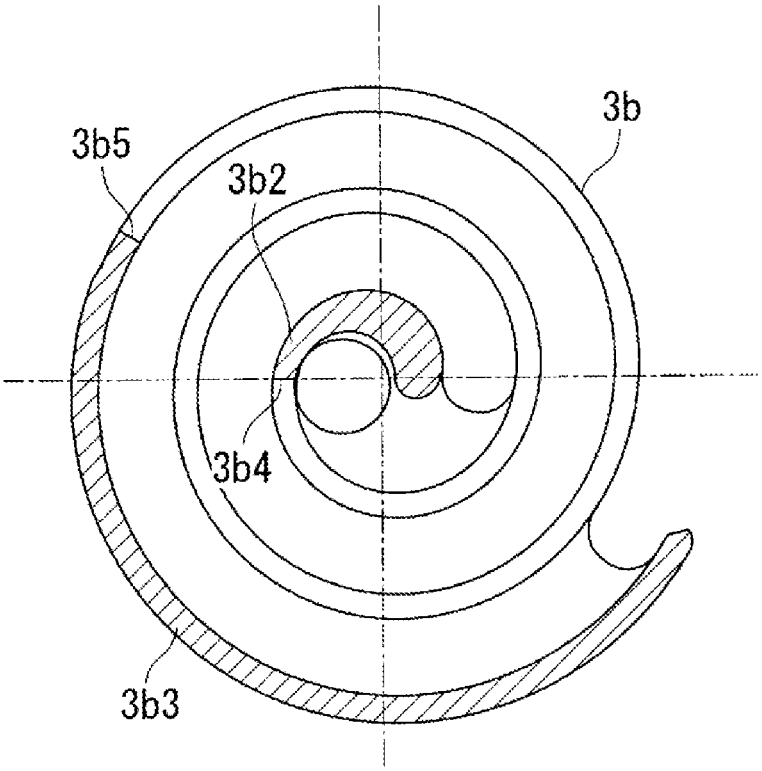
FIG. 4 is a plan view illustrating a wall flat portion provided in the fixed scroll.

As illustrated with hatching in FIG. 3 and FIG. 4, the fixed scroll 3 includes end plate flat portions 3*a*2 and 3*a*3, wall flat portions 3*b*2 and 3*b*3, end plate inclined connecting portions 3*a*4 and 3*a*5 and wall inclined connecting portions 3*b*4 and 3*b*5 as with the orbiting scroll 5.

Figure 5:
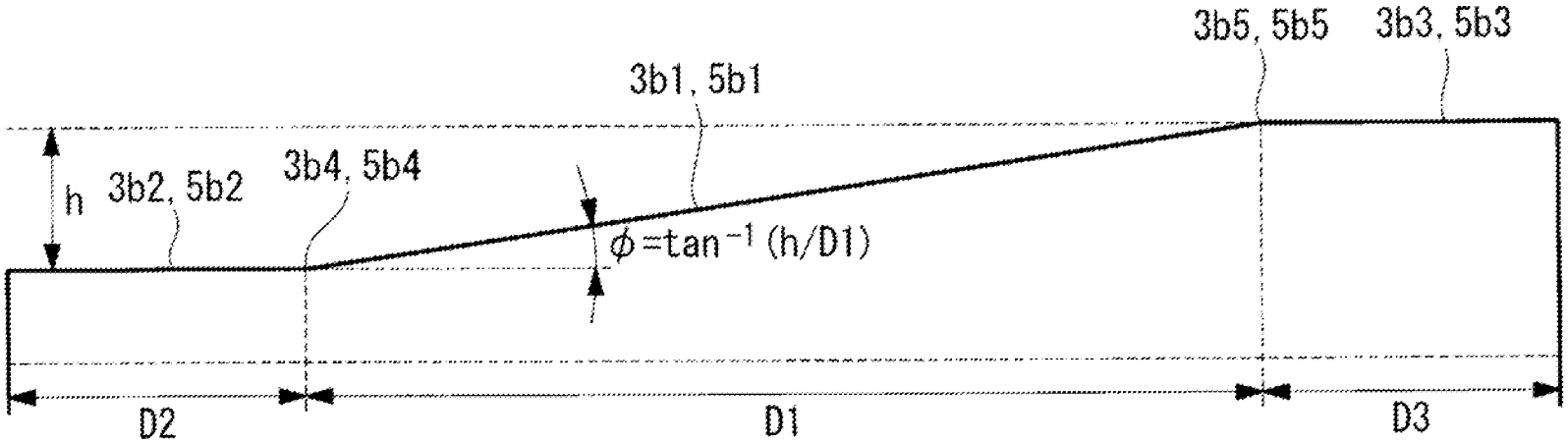
FIG. 5 is a schematic view illustrating a wall unrolled in the spiral direction.

FIG. 5 illustrates the walls 3*b* and 5*b* unrolled in the spiral direction. As illustrated in the drawing, the wall flat portions 3*b*2 and 5*b*2 on the innermost peripheral side are provided over a distance D2, and the wall flat portions 3*b*3 and 5*b*3 on the outermost peripheral side are provided over a distance D3. The distance D2 and the distance D3 correspond to the regions of 180° of the scrolls 3 and 5 around centers O1 and O2. The wall inclined portions 3*b*1 and 5*b*1 are provided over the distance D2 between the wall flat portions 3*b*2 and 5*b*2 on the innermost peripheral side and the wall flat portions 3*b*3 and 5*b*3 on the outermost peripheral side. When a height difference between the wall flat portions 3*b*2 and 5*b*2 on the innermost peripheral side and the wall flat portions 3*b*3 and 5*b*3 on the outermost peripheral side is represented by h, an inclination φ of the wall inclined portions 3*b*1 and 5*b*1 is expressed as follows.

$$\varphi=\tan^{-1}(h/D1) \quad (1)$$

In this manner, the inclination φ of the inclined portion is constant with respect to the circumferential direction in which the walls 3*b* and 5*b* having the spiral shape extend.

Figure 6:
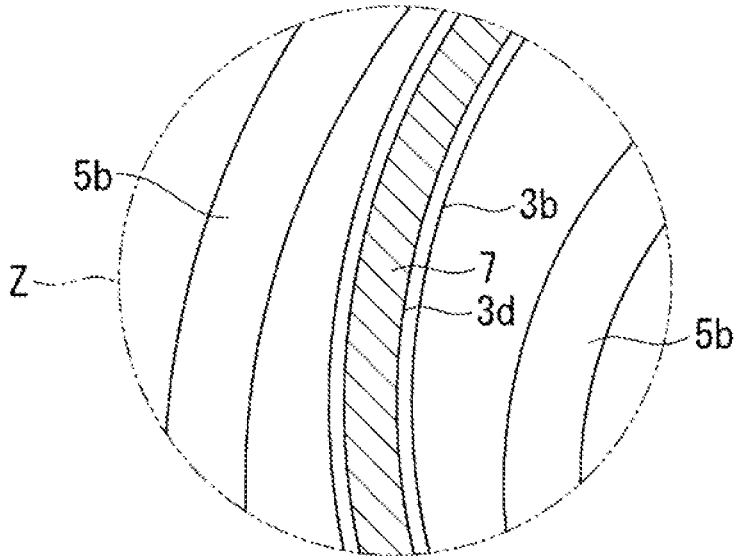
FIG. 6 is a partially enlarged view of the region indicated with reference sign Z in FIG. 1B.

FIG. 6 illustrates an enlarged view of the region indicated by reference sign Z in FIG. 1B. As illustrated in FIG. 6, a tip seal 7 is provided in the tooth crest of the wall 3*b* of the fixed scroll 3. The tip seal 7 is made of elastically deformable resin, and makes contact with the opposing tooth base of the end plate 5*a* of the orbiting scroll 5 to perform sealing against fluid. The tip seal 7 is housed in a tip seal groove (groove portion) 3*d* formed in the tooth crest of the wall 3*b* over the circumferential direction.

Figure 7A:
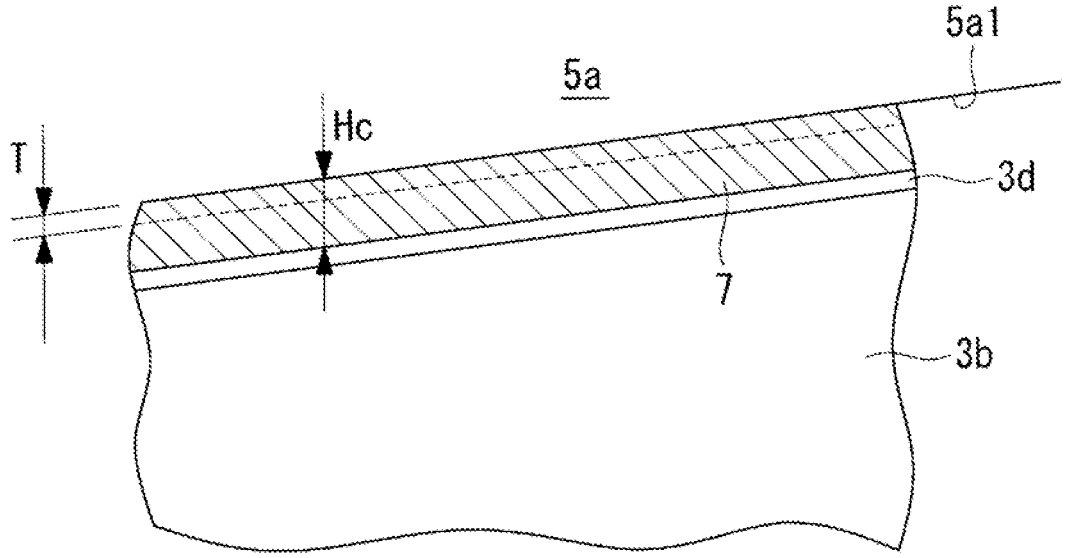
FIGS. 7A and 7B illustrate a tip seal gap of the portion illustrated in FIG. 6.
Figure 7B:
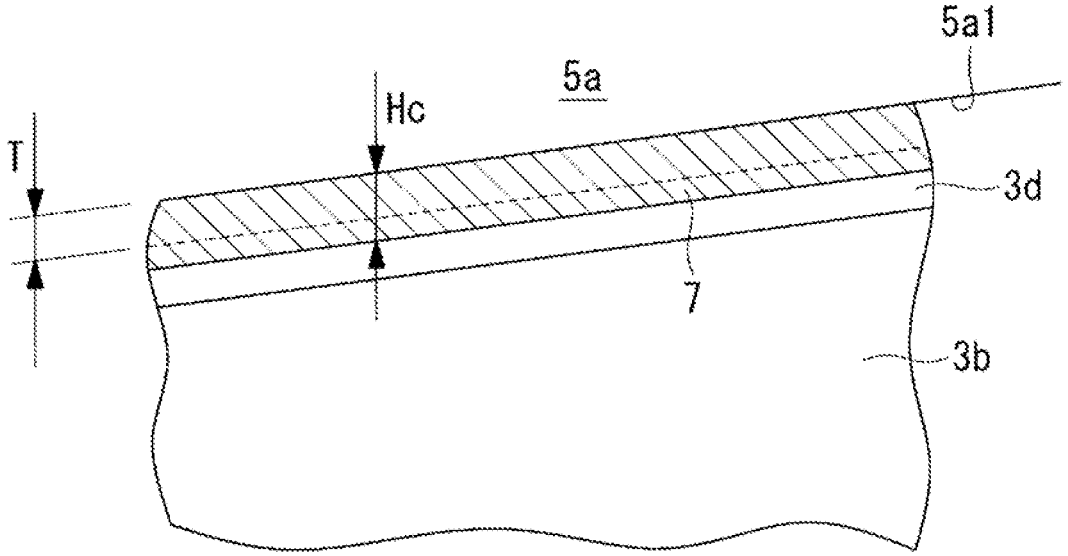

As illustrated in FIGS. 7A and 7B, a height Hc of the tip seal 7 in the height direction of the wall 3*b* is constant in the spiral direction. Also, the depth of the tip seal groove 3*d* is constant in the spiral direction.

When the scrolls 3 and 5 perform relative rotation in orbital motion, the positions of the tooth crest and the tooth base are relatively shifted by an orbit diameter (the orbit radius ρ×2). In the inclined portion, the tip clearance between the tooth crest and the tooth base varies in response to the positional displacement of the tooth crest and the tooth base. For example, FIG. 7A illustrates a small tip clearance T, and FIG. 7B illustrates a large tip clearance T. Even when the tip clearance T is varied by an orbital motion, the tip seal 7 is pressed from the back surface toward the tooth base of the end plate 5*a* by compression fluid which has entered the tip seal groove 3*d*, and thus can follow up and perform sealing.

It is to be noted that the tip seal is provided also in the tooth crest of the wall 5*b* of the orbiting scroll 5.

Figure 8:
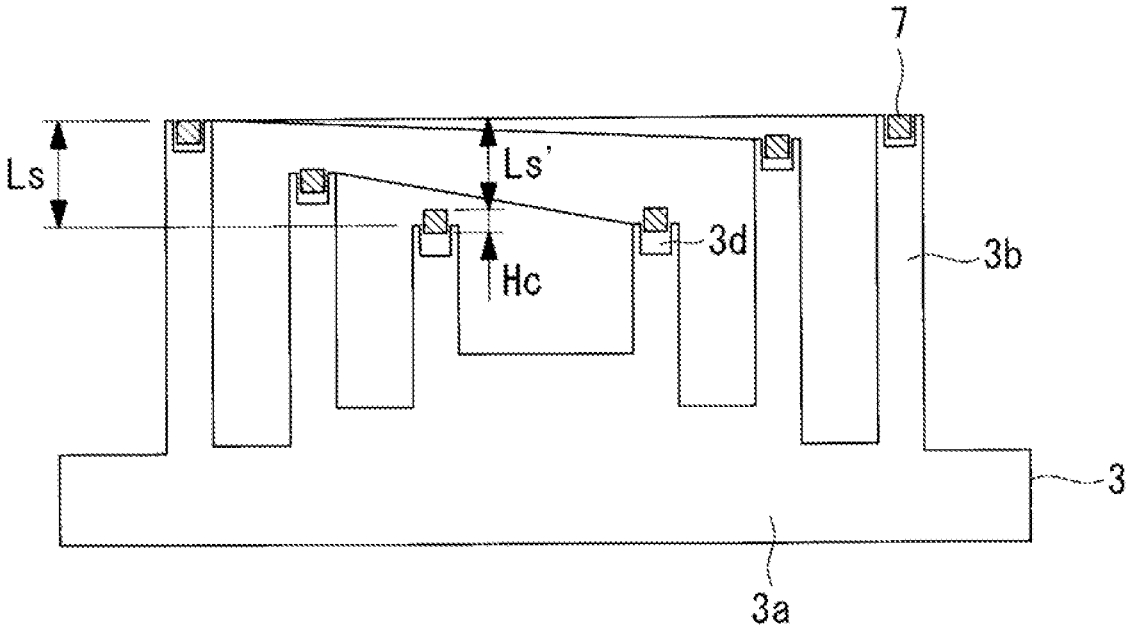
FIG. 8 is a longitudinal sectional view illustrating an installation position of the tip seal provided in the tooth crest of the wall in a non-load state.

FIG. 8 illustrates a state where the tip seal 7 is installed in the fixed scroll 3. The state illustrated in this drawing is a non-load state where no pressure of compression fluid is exerted on the compression chamber, that is, a stop state of the scroll compressor 1. In addition, this state corresponds to a state before the fixed scroll 3 is engaged with the orbiting scroll 5 and mounted to the main body of the scroll compressor 1 in manufacture of the scroll compressor 1.

The inclination height Ls' of the tip seal 7 is set to a value smaller than that of the inclination height Ls of the wall 3*b*. Here, the inclination height Ls' of the tip seal 7 is a difference between the height of a position in the tip seal 7 which corresponds to the wall inclined connecting portion 3*b*5 (see FIG. 5) located on the outer peripheral side in the wall 3*b*, and the height of a position in the tip seal 7 which corresponds to the wall inclined connecting portion 3*b*4 (see FIG. 5) located on the inner peripheral side in the wall 3*b*. The inclination height Ls of the wall 3*b* is a difference between the height of the wall inclined connecting portion 3*b*5 on the outer peripheral side and the height of the wall inclined connecting portion 3*b*4 on the inner peripheral side.

To install the tip seal 7 as illustrated in FIG. 8, a flat tip seal 7 whose inclination height Ls' in the state where no external force is applied thereto is set to 0 is prepared. Then, the tip seal is installed in the tip seal groove 3*d* by utilizing elastic deformation of the tip seal 7 (tip seal installation step). When the outer peripheral surface and/or the inner peripheral surface of the tip seal 7 make contact with the wall portion of the tip seal groove 3*d*, a frictional force is generated and thus the relative position of the tip seal 7 with respect to the tip seal groove 3*d* is fixed. Accordingly, even in the case where the fixed scroll 3 is inclined or inverted when the fixed scroll 3 is mounted and installed (in a scroll installation step), the relative position of the tip seal 7 with respect to the tip seal groove 3*d* is not significantly shifted. It should be noted that the frictional force between the wall portion of the tip seal groove 3*d* and the outer peripheral surface and/or the inner peripheral surface of the tip seal 7 is set to a value that allows, when fluid enters the tip seal groove 3*d* and turns around the back surface of the tip seal 7 during operation of the scroll compressor 1, the tip seal 7 under the fluid pressure to move toward the opposing tooth base (in the direction in which the tip seal 7 goes out from the tip seal groove 3*d*).

The height Hc of the tip seal is greater than the difference between the inclination height Ls of the wall 3*b* and the inclination height Ls' of the tip seal 7. That is, the height Hc of the tip seal 7 is set to satisfy the following equation.

$$Ls-Ls' \leq Hc \quad (2)$$

In addition, the inclination height Ls' of the tip seal 7 is set also in the tooth crest of the wall 5*b* of the orbiting scroll 5 as in FIG. 8.

The above-described scroll compressor 1 operates in the following manner.

The orbiting scroll 5 is rotated in orbital motion around the fixed scroll 3 by a driving source such as an electric motor not illustrated. In this manner, fluid is sucked from the outer peripheral side of the scrolls 3 and 5, and the fluid is taken into the compression chamber surrounded by the walls 3*b* and 5*b* and the end plates 3*a* and 5*a*. The fluid in compression chamber is compressed as it moves from the outer peripheral side toward the inner peripheral side, and finally compressed fluid is discharged from the discharge port 3*c* formed in the fixed scroll 3. When the fluid is compressed, the fluid is compressed also in the height direction of the walls 3*b* and 5*b* in the inclined portion defined by the end plate inclined portions 3*a*1 and 5*a*1 and the wall inclined portions 3*b*1 and 5*b*1, and thus three-dimensional compression is performed.

According to the present embodiment, the following effects are achieved.

The inclination height Ls' of the tip seal 7 in a stop state where compression of fluid by the scrolls 3 and 5 is not performed is set to a value smaller than that of the inclination height of the walls 3*b* and 5*b*. With this configuration, the tip seal 7 is installed such that the tip seal 7 protrudes from the tooth crest to the tooth base side more on the inner periphery side than on the outer peripheral side in the stop state (see FIG. 8). Since the tip seal 7 protrudes to the tooth base side more on the inner periphery side than on the outer peripheral side, the fluid enters, more easily on the inner peripheral side than on the outer peripheral side, the tip seal groove 3*d* in which the tip seal 7 is inserted. When an operation is started from the stop state and the compression of the fluid is performed by the scrolls 3 and 5, the compressed fluid enters the tip seal groove 3*d* of the inner periphery side of the tip seal 7, and biases the tip seal 7 toward the tooth base from the back surface of the tip seal 7. Accordingly, the pressing forth of the tip seal 7 against the tooth base is larger on the inner periphery side where the fluid pressure is high during operation, and thus a high sealing performance can be achieved, improving the performance of the scroll compressor 1.

Since the height Hc of the tip seal is greater than the difference between the inclination height Ls' of the tip seal 7 and the inclination height Ls of the walls 3*b* and 5*b* (see the expression (2)), the tip seal 7 can be prevented from dropping off from the tip seal groove 3*d*.

When the tip seal 7 is made of a material such as an elastically deformable resin, the tip seal 7 can be installed by utilizing elastic deformation. That is, the tip seal 7 can be installed in the tip seal groove 3*d* so as to be elastically deformed such that the inclination height Ls' of the tip seal 7 is smaller than the inclination height Ls of the walls 3*b* and 5*b* in the stop state. As a result, it is unnecessary to form the tip seal 7 in a shape inclined in the height direction, and therefore, by manufacturing flat tip seal 7 that has no inclination when no external force is applied thereto, the ease of manufacture and inspection of the tip seal 7 increases.

In addition, while the end plate inclined portions 3*a*1 and 5*a*1 and the wall inclined portions 3*b*1 and 5*b*1 are provided in the scrolls 3 and 5 in the above-mentioned embodiment, the end plate inclined portion and the wall inclined portion may be provided in only one of the scrolls 3 and 5.

Figure 9A:
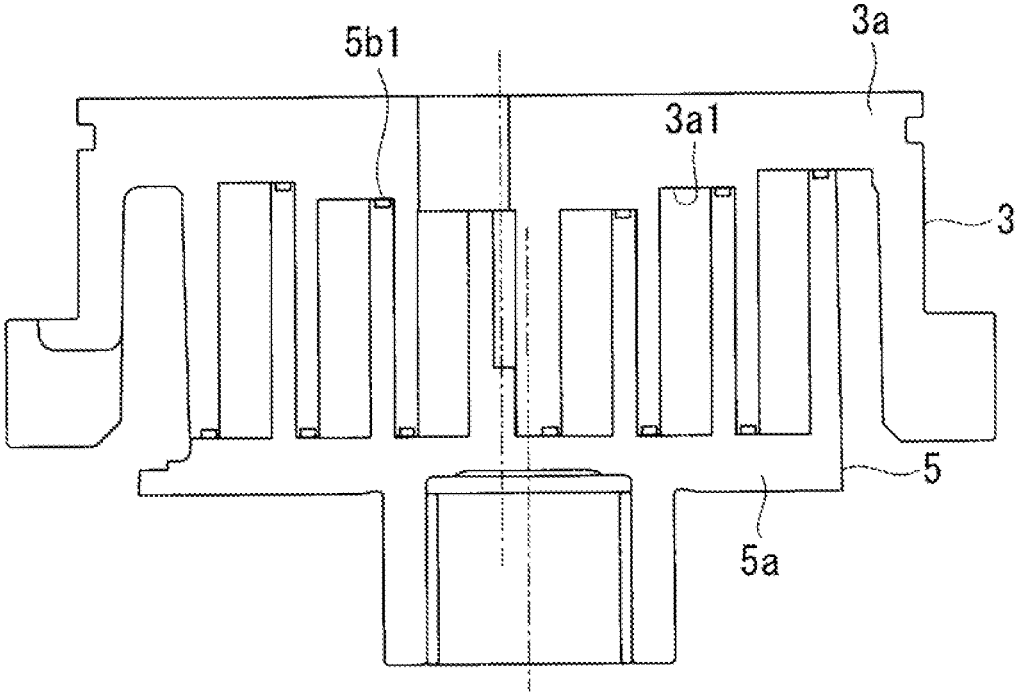
FIGS. 9A and 9B illustrate a modification.

To be more specific, in the case where the wall inclined portion 5*b*1 is provided in the wall of one scroll (the orbiting scroll 5, for example) and the end plate inclined portion 3*a*1 is provided in the end of plate 3*a* of the other scroll as illustrated in FIG. 9A, the wall of the other scroll and the end plate 5*a* of the one scroll may be flat.

Figure 9B:
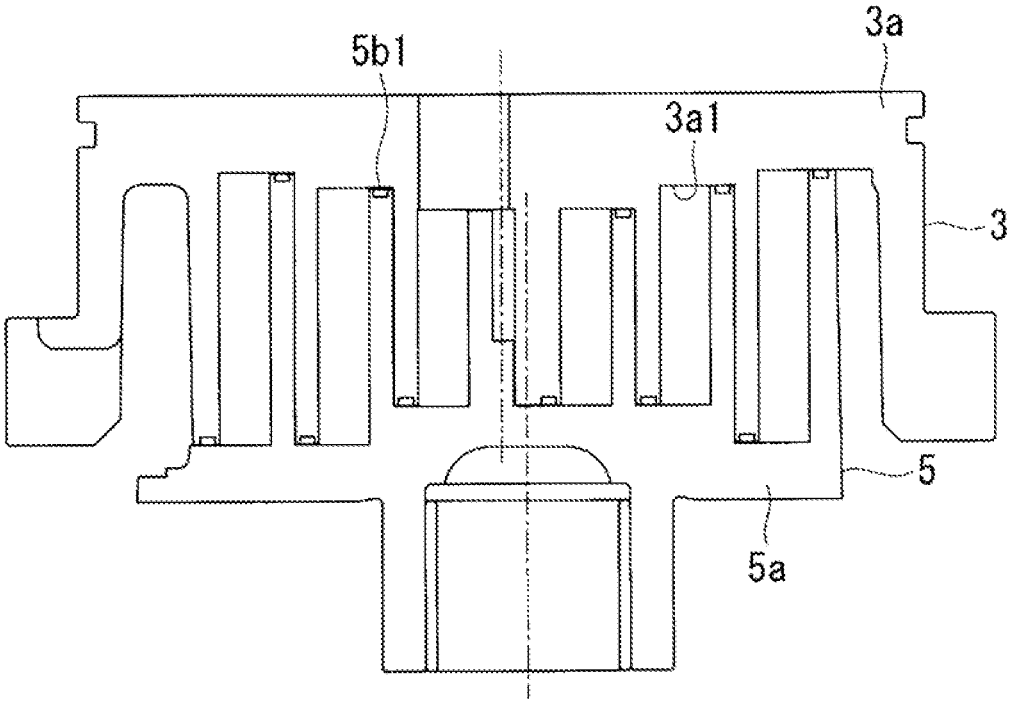

In addition, as illustrated in FIG. 9B, it is possible to adopt a shape combined with a stepped shape of the related art, that is, a shape combined with a shape in which the end plate inclined portion 3*a*1 is provided in the end plate 3*a* of the fixed scroll 3 and a step is provided in the end plate 5*a* of the orbiting scroll 5.

While the wall flat portions 3*b*2 3*b*3, 5*b*2 and 5*b*3 and the end plate flat portions 3*a*2 3*a*3, 5*a*2 and 5*a*3 are provided in the above-mentioned embodiment, the flat portion of the inner peripheral side and/or the outer peripheral side may be omitted so as to extend the inclined portion in the entirety of the walls 3*b* and 5*b*.

While a scroll compressor is described in the above-mentioned embodiment, the present invention is applicable to a scroll expander used as an expander.

REFERENCE SIGNS LIST

1 Scroll Compressor (Scroll Fluid Machine)
3 Fixed Scroll (First Scroll Member)
3*a* End Plate (First End Plate)
3*a*1 End Plate Inclined Portion
3*a*2 End Plate Flat Portion (Inner Peripheral Side)
3*a*3 End Plate Flat Portion (Outer Peripheral Side)
3*a*4 End Plate Inclined Connecting Portion (Inner Peripheral Side)
3*a*5 End Plate Inclined Connecting Portion (Outer Peripheral Side)
3*b* Wall (First Wall)
3*b*1 Wall Inclined Portion
3*b*2 Wall Flat Portion (Inner Peripheral Side)
3*b*3 Wall Flat Portion (Outer Peripheral Side)
3*b*4 Wall Inclined Connecting Portion (Inner Peripheral Side)
3*b*5 Wall Inclined Connecting Portion (Outer Peripheral Side)
3*c* Discharge port
3*d* Tip Seal Groove (Groove Portion)
5 Orbiting Scroll (Second Scroll Member)
5*a* End Plate (Second End Plate)
5*a*1 End Plate Inclined Portion
5*a*2 End Plate Flat Portion (Inner Peripheral Side)

5a3 End Plate Flat Portion (Outer Peripheral Side)
5b Wall (Second Wall)
5b1 Wall Inclined Portion
5b2 Wall Flat Portion (Inner Peripheral Side)
5b3 Wall Flat Portion (Outer Peripheral Side)
5b4 Wall Inclined Connecting Portion (Inner Peripheral Side)
5b5 Wall Inclined Connecting Portion (Outer Peripheral Side)
7 Tip Seal
Hc Height of Tip Seal
L Distance between Opposing Surfaces
Ls Inclination Height of Wall
Ls' Inclination Height of Tip Seal
T Tip Clearance
Φ Inclination

The invention claimed is:

1. A scroll fluid machine comprising:

a first scroll member including a first end plate and a first wall provided on the first end plate, the first wall having a spiral shape; and a second scroll member including a second end plate that is disposed to face the first end plate, and a second wall provided on the second end plate, the second scroll member being configured to relatively rotate in orbital motion with the second wall engaged with the first wall, the second wall having a spiral shape, wherein an inclined portion in which a distance between opposing surfaces of the first end plate and the second end plate facing each other gradually decreases from an outer peripheral side toward an inner peripheral side of the first wall and the second wall is provided, a tip seal is provided in groove portions formed in tooth crests of the first wall and the second wall corresponding to the inclined portion, the tip seal being configured to make contact with a tooth base facing the tip seal to perform sealing against fluid, and in a stop state where the scroll members do not perform compression of fluid, an inclination height of the tip seal is smaller than an inclination height of the wall, the inclination height of the tip seal is a difference between a height of the tip seal at a position corresponding to an outer peripheral side of the inclined portion of the first wall and a height of the tip seal at a position corresponding to an inner peripheral side of the inclined portion of the first wall and, a difference between a height of the tip seal at a position corresponding to an outer peripheral side of the inclined portion of the second wall and a height of the tip seal at a position corresponding to an inner peripheral side of the inclined portion of the second wall, and the inclination height of the wall is a difference between a height on the outer peripheral side of the inclined portion of the first wall and a height on the inner peripheral side of the inclined portion of the first wall and, a difference between a height on the outer peripheral side of the inclined portion of the second wall and a height on the inner peripheral side of the inclined portion of the second wall.

2. The scroll fluid machine according to claim 1, wherein a height of the tip seal in a height direction of the first wall and the second wall is greater than a difference between the inclination height of the wall and the inclination height of the tip seal.

3. The scroll fluid machine according to claim 2, wherein the tip seal is made of an elastically deformable material.

4. The scroll fluid machine according to claim 1, wherein the tip seal is made of an elastically deformable material.

5. A method of manufacturing a scroll fluid machine, the scroll fluid machine including:

a first scroll member including a first end plate and a first wall provided on the first end plate, the first wall having a spiral shape; and a second scroll member including a second end plate that is disposed to face the first end plate, and a second wall provided on the second end plate, the second scroll member being configured to relatively rotate in orbital motion with the second wall engaged with the first wall, the second wall having a spiral shape, wherein an inclined portion in which a distance between opposing surfaces of the first end plate and the second end plate facing each other gradually decreases from an outer peripheral side toward an inner peripheral side of the first wall and the second wall is provided, and a tip seal is provided in groove portions formed in tooth crests of the first wall and the second wall corresponding to the inclined portion, the tip seal being configured to make contact with a tooth base facing the tip seal to perform sealing against fluid, the method comprising:

installing the tip seal in the groove portions such that an inclination height of the tip seal is smaller than an inclination height of the wall; and installing the first scroll member and the second scroll member by engaging the first scroll member with the second scroll member after installing the tip seal, wherein the inclination height of the tip seal is a difference between a height of the tip seal at a position corresponding to an outer peripheral side of the inclined portion of the first wall and a height of the tip seal at a position corresponding to an inner peripheral side of the inclined portion of the first wall and, a difference between a height of the tip seal at a position corresponding to an outer peripheral side of the inclined portion of the second wall and a height of the tip seal at a position corresponding to an inner peripheral side of the inclined portion of the second wall, and the inclination height of the wall is a difference between a height on the outer peripheral side of the inclined portion of the first wall and a height on the inner peripheral side of the inclined portion of the first wall and a difference between a height on the outer peripheral side of the inclined portion of the second wall and a height on the inner peripheral side of the inclined portion of the second wall.

* * * * *